US006023035A

United States Patent [19]

Azzola et al.

[11] Patent Number: 6,023,035

[45] Date of Patent: Feb. 8, 2000

[54] ELECTRIC CIRCUIT BREAKER WITH MEANS FOR ADJUSTING THE CONTACTS

[75] Inventors: Lucio Azzola; Gustavo Brignoli, both of Bergamo, Italy

[73] Assignee: ABB Sace S.p.A., Bergamo, Italy

[21] Appl. No.: 08/993,040

[22] Filed: Dec. 18, 1997

[30] Foreign Application Priority Data

Dec. 20, 1996 [IT] Italy ..... M196A2688

[51] Int. Cl.[7] ..... H01H 33/14; H01H 9/40

[52] U.S. Cl. ..... 218/7; 218/154; 218/36; 218/2

[58] Field of Search ..... 218/1, 2, 4, 6, 218/7, 14, 20, 21, 36, 40, 148, 154; 335/167–76, 201

[56] References Cited

U.S. PATENT DOCUMENTS 2,117,892 5/1938 Koch ..... 218/6

4,551,597 11/1985 Maier .

4,616,202 10/1986 Kakizoe ..... 335/133

5,359,161 10/1994 Leach et al. ..... 218/6

5,519,180 5/1996 Zaffetti et al. .

*Primary Examiner*—Lincoln Donovan

*Attorney, Agent, or Firm*—Guido Modiano; Albert Josif

[57] ABSTRACT

Electric circuit breaker with means for adjusting the contacts comprising, for each electric phase, moving levers having main contacts and arc-breaking contacts co-operating with main contacts and arc-breaking contacts provided on a terminal bar there being provision for the levers loaded by springs to be supported by a crank pivoting about a pin and for the crank to be operationally connected to a link-rod articularly joined to an operating shaft and for each end of the operating shaft to have translatable and position-adjustable supports.

5 Claims, 3 Drawing Sheets

ELECTRIC CIRCUIT BREAKER WITH MEANS FOR ADJUSTING THE CONTACTS

BACKGROUND OF THE INVENTION

The invention relates to an electric circuit breaker with means for adjusting the contacts, comprising for each electric phase moving levers having main contacts and arc-breaking contacts co-operating with main contacts and arc-breaking contacts provided on a terminal bar.

It is known from the prior art that industrial low-voltage circuit breakers accomplish two tasks in the main: allowing the flow of a rated current and interrupting higher overload or short-circuit currents. These two tasks, investigated from the point of view of the electric contacts, are mutually conflicting.

Thus, in order to guarantee low consumption and a low working temperature during the flow of the rated current, the electric contacts require a small resistivity. On the other hand, for the purpose of interrupting overcurrents, the requirement demanded of the electric contacts is a high resistance to the electric arc generated during the interruption of an overcurrent or short-circuit and hence high resistivity.

Being impossible to satisfy with the same material the requirement of low resistivity and high thermal resistance simultaneously the tasks of transmitting the rated current and of interrupting overcurrents are accomplished by two distinct contacts made from different materials.

The function of carrying the rated current is accomplished by the first contacts or main contacts, made from softer material. The function of interrupting the overload or short-circuit current is accomplished by second contacts or arc-breaking contacts, made from tougher materials.

Metal inserts, constituting the main contacts and moving arc-breaking contacts, are inserted at various heights on moving levers supported by cranks pivoting on the box of the circuit breaker. Corresponding metal inserts, constituting the main contacts and the fixed arc-breaking contacts, are inserted on the end of upper terminal bars of the circuit breaker.

A known linkage generates, during the opening phase, the movement of the contact-carrying levers which effects the switchover from the main contacts to the arc-breaking contacts. To obtain correct operation of the circuit breaker it is necessary for the switchover from the main to the arc-breaking contacts to take place in accordance with an accurate time sequence. The desired accuracy in the time sequence is obtained by adjustment of the distance of the corresponding fixed and moving contacts.

At the present time, this adjustment is performed by rotating the moving contact-carrying levers, by virtue of a known adjustment device, acting on each contact-carrying lever.

The operation of adjusting the position of the individual contacts of the complete circuit breaker is made extremely arduous and lengthy due to the presence inside the circuit breakers of three or four electric phases, each made with several contact-carrying levers, for example eight levers, each having a main contact and an arc-breaking contact.

These operations are usually carried out by specialist staff using for example suitable feeler gauges inserted between the corresponding fixed and moving arc-breaking contacts, when the circuit breaker is closed and therefore when the main contacts are shut. The adjustment operation is performed by rotating the individual contact-carrying lever until the feeler gauge is clamped between the arc-breaking contacts with the desired force.

As may easily be appreciated, this operation requires a certain accuracy in its performance and hence, given also the considerable number of contacts present in the circuit breaker, makes this phase of the manufacture of the circuit breaker extremely lengthy.

SUMMARY OF THE INVENTION

The objective of the present invention is to overcome the drawbacks of the prior art and to allow the simultaneous adjustment of all the contacts of the circuit breaker by a few simple operations.

The objectives of the invention are achieved by means of an electric circuit breaker with means for adjusting the contacts, comprising for each electric phase moving levers having main contacts and arc-breaking contacts co-operating with main contacts and arc-breaking contacts provided on a terminal bar, characterized in that a pin receives a pivoting crank, in that the levers of the contacts, loaded by springs, are fulcrumed to the crank, in that the crank is operationally connected to a link-rod articularly joined to an operating shaft and in that each end of the operating shaft is supported by translatable adjustment supports.

A simple constructional realization of the invention can consist in the fact that the supports are made as slides running in slots, made in the abutments of the box of the circuit breaker, and in that they have means for adjusting the position of the slide.

Advantageously the slide exhibits laterally a seat for a head of a screw, the screw is inserted into a threaded hole present on a projection made laterally to the slot and the screw is locked by a nut.

To obtain accurate and hence play-free adjustment, the seat, made on the slide, has its inner surfaces in contact with the upper and lower faces of the head of the adjusting screw. To ease the closing and opening movement of the circuit breaker the slides have housings for the pins of the operating shaft which are made of self-lubricating material.

The advantages of the present invention may be summarized mainly in the simplified and easier operation of simultaneous adjustment of the contacts of the circuit breaker.

An advantage lies moreover in the reduction in the components required for the adjustment of the contacts and a consequent simplification and reduction in the phases of assembling the circuit breaker.

BRIEF DESCRIPTION OF THE DRAWINGS

The subject, devised according to the present invention, will be described below in greater detail and illustrated in an embodiment given, merely by way of example, in the appended drawings in which.

DESCRIPTION OF THE PREFERRED EMBODIMENTS

Figure 1:
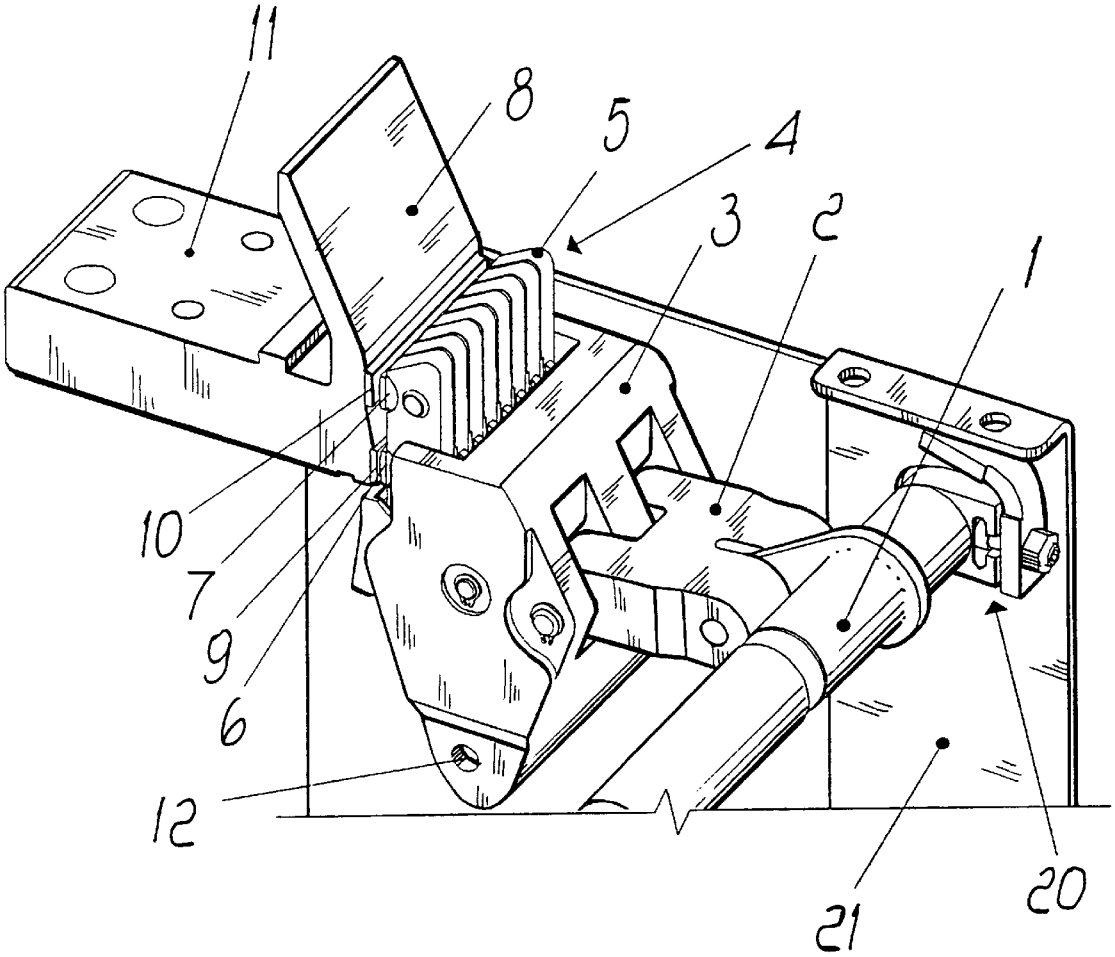
FIG. 1 illustrates, in partially sectioned axonometric view, the mechanism for operating the contacts of an electric phase of a circuit breaker.

The manner of construction and operation of the electric circuit breaker are essentially known, so that details of only the parts which are novel and essential to the invention will be provided below.

From the figures it is possible to observe some of the components constituting one of the phases of a circuit breaker, which is illustrated in the closed position.

An operating shaft 1 is connected by means of an insulating link-rod 2 to a crank 3 constituting the support for levers having moving contacts, which are indicated 4 as a whole.

The crank 3 can pivot about a pin 12, which is integral with the abutments 21 of the circuit breaker.

The moveable contacts 4 are made, for example, by means of eight levers, or fingers 5, each carrying a main contact 6 and an arc-breaking contact 7. The fixed contacts, indicated 8 as a whole, face the moveable contacts 6,7. The fixed main contacts 9 and the fixed arc-breaking contacts 10 are supported by an upper terminal bar 11 which is used for the electrical connection of the circuit breaker to the electrical installation.

Springs 13 push the levers 5 carrying the moveable main contacts 6 against the fixed main contacts 9 with a force necessary to have an area of contact wide enough to guarantee low electrical resistance and additionally preload the linkage consisting of the crank 3, the link-rod 2 and the operating shaft 1.

The operating shaft 1 transmits a movement imposed by a control, not illustrated, simultaneously to the three or four phases of the circuit breaker. Only one phase is depicted in the figures. The ends of the operating shaft 1 are connected, by means of a support indicated 20 as a whole, to the abutments 21 of the box of the circuit breaker.

Figure 2:
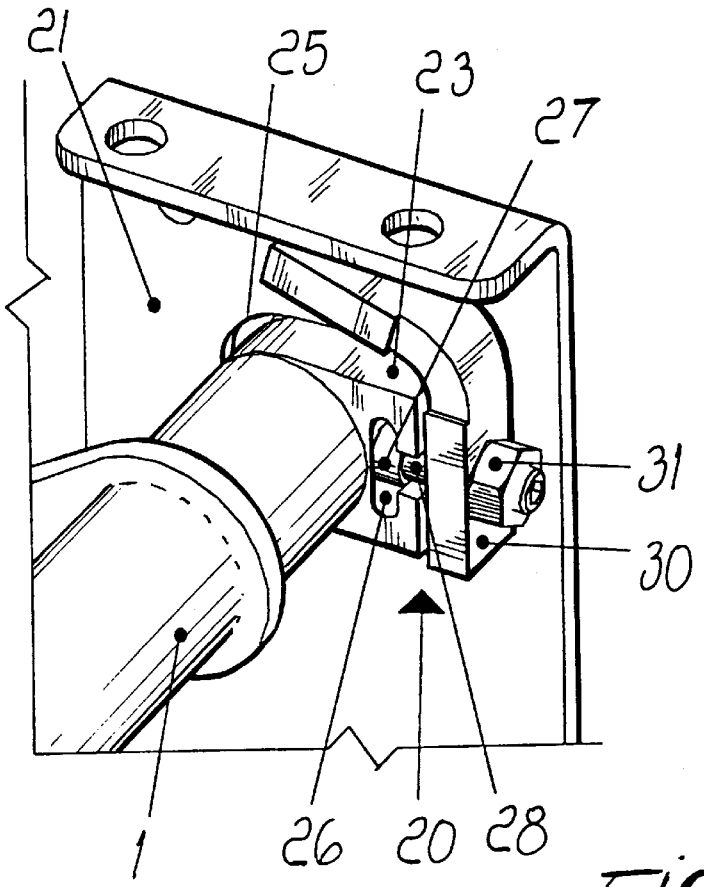
FIG. 2 illustrates, in partially sectioned axonometric view, a support for adjusting the operating shaft.
Figure 3:
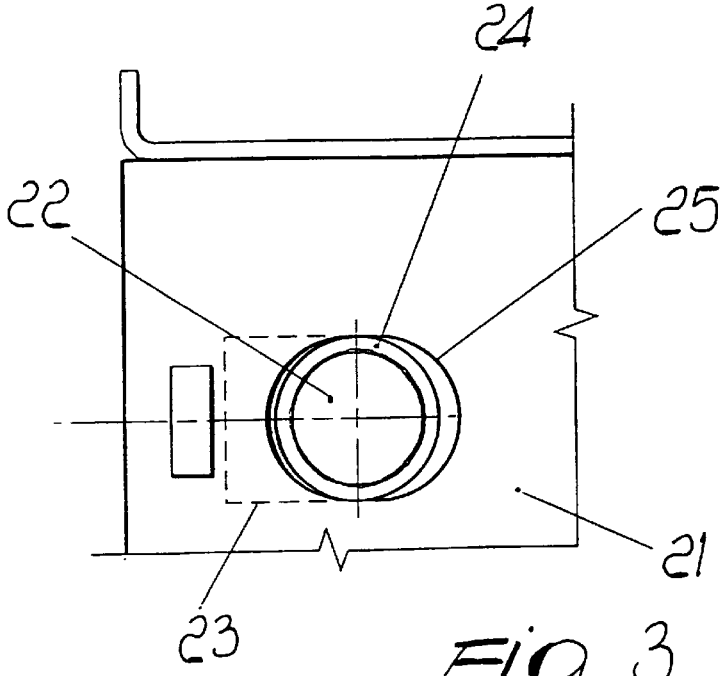
FIG. 3 illustrates the support of the operating shaft viewed in the direction of the arrow X of FIG. 2.

From FIGS. 2 and 3 it is possible to observe the main components which make up the adjustable support 20.

The operating shaft 1 has a pin, in this case the end pin 22, inserted into a circular seat of a slide 23.

Advantageously the circular seat is made from a self-lubricating material so as to reduce the friction between pin 22 and the circular seat during the rotation of the operating shaft 1.

The slide 23 exhibits laterally a cylindrical extension 24 constituting the prolongation of the circular seat of the pin 22. The cylindrical extension 24 is inserted into a slot 25 made in the abutment 21 of the box. Which slot constitutes a guide in which the cylindrical extension 24 of the slide 23 can run.

At the front the slide 23 has a seat 26 for the head 27 of a screw 28. The seat 26 made in the slide 23 hugs the head 27 of the screw 28, disallowing any axial movement of the screw relative to the slide. In particular, the surfaces of the seat 26 are in contact with the upper and lower faces of the head 27 of the screw 28.

A projection 30 is fixed to the flank 21 in front of the slot 25 so as to constitute a stop for the slide 23.

The shank of the screw 28 is screwed into a threaded hole present in the projection 30 and protrudes from the opposite part of the projection 30. A nut 31 is screwed onto the shank of the screw 28, protruding from the projection 30.

Figure 4:
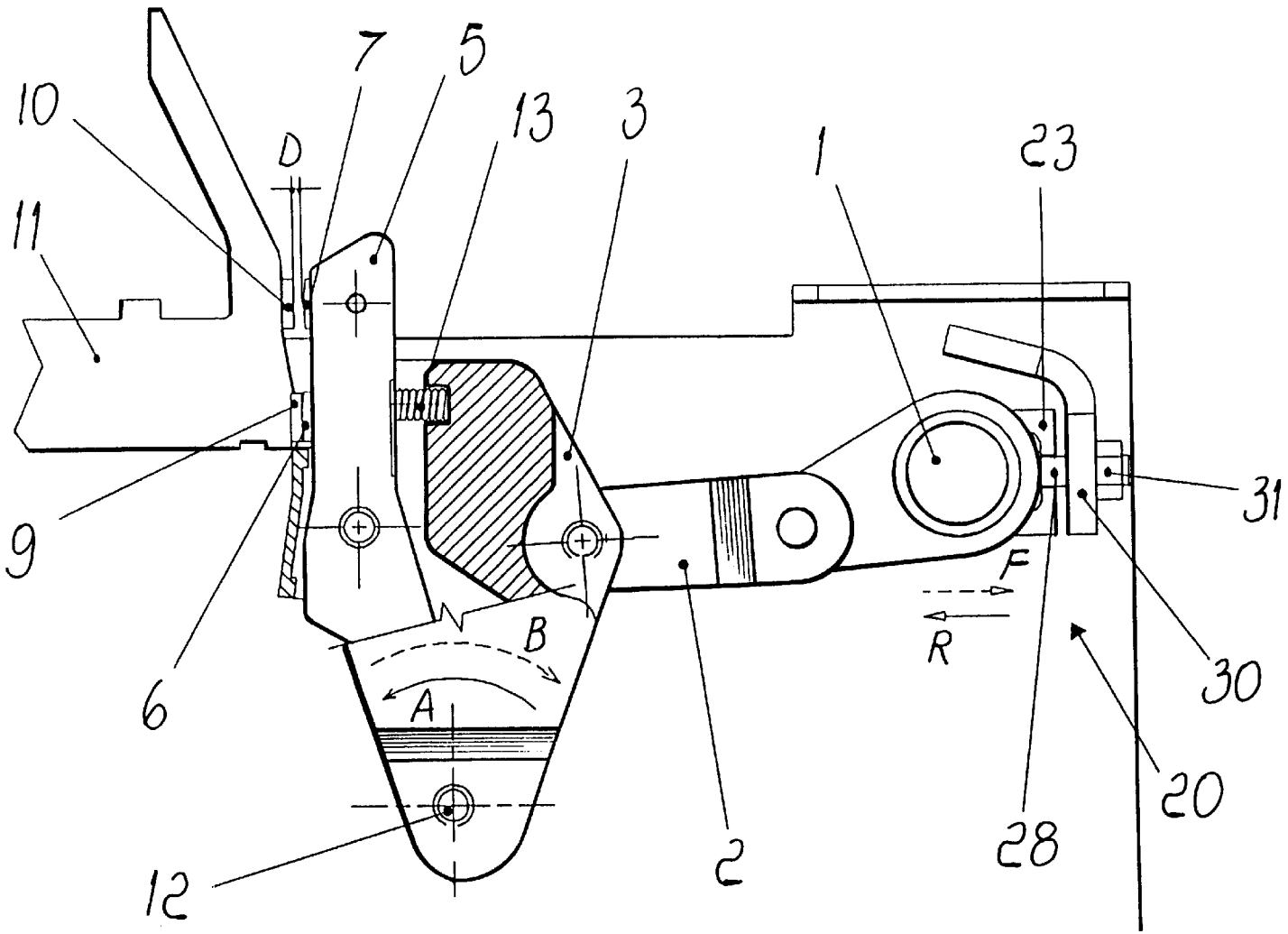
FIG. 4 illustrates, diagrammatically in a side view in partial cross-section, the mechanism according to FIG. 1.

The operation of the device which is the subject of the invention may be observed from FIG. 4.

The operating shaft 1 controls via the insulating link-rod 2 the rotation (in the direction of the arrows A and B) about the pin 12 of the moving contact-carrying crank 3.

The operating shaft 1 is mounted on the slides 23 translating inside the slots 25 made in the abutments or in the central ribs of the box of the circuit breaker. By loosening the nut 31 it is possible to rotate the screw 28 and displace, inside the slot 25, the slide 23 supporting the operating shaft 1 towards the front (F) of the circuit breaker or towards the rear (R) of the circuit breaker, thereby obtaining a rotation of the moving contact-carrying crank 3 with respect to the crank pin 12, respectively clockwise (in the direction of the arrow B) or anticlockwise (in the direction of the arrow A).

Through the fulcrum effect which is generated at the point of opposition between the fixed 9 and moveable 6 main contacts, on account of the displacement of the slide 23 towards the front (F) or the rear (R) of the circuit breaker, the fingers 5 rotate, respectively increasing or decreasing the distance (D) between the fixed 10 and moveable 7 arc-breaking contacts of the circuit breaker.

The distance between the arc-breaking contacts 10,7 is thus a design datum which defines the time sequence for switching the current from the main contacts 9,6 to the arc-breaking contacts 10,7 so as to safeguard the main contacts 9,6, made from soft material, from wear caused by the extinction of the electric arc during the circuit breaker opening operations.

The tightening of the nut 31 ensures that the adjustment performed is guaranteed to be unimpaired throughout the working of the circuit breaker.

Simultaneous adjustment of the distances between all the arc-breaking contacts 10,7 by means of the displacement of the supports 20 of the operating shaft 1, presupposes precise alignment of the fingers 5 carrying the moving contacts 6,7. Which alignment has to be guaranteed in the design and assembly phase by virtue of a good constructional tolerance.

What is claimed is:

1. An electric circuit breaker with means for adjusting the contacts, comprising, for each electric phase, moving levers having main contacts and arc-breaking contacts co-operating with fixed main contacts and fixed arc-breaking contacts provided on a terminal bar, wherein a pin integral with abutments of the circuit breaker receives a pivoting crank which supports said moving levers; wherein the moving levers, loaded by springs, are fulcrumed to the crank; wherein the crank is operationally connected to a link-rod articulately joined to an operating shaft and wherein each end of the operating shaft is supported by translatable adjustment supports adapted to adjust the distance between the arc-breaking contact of the moving levers and the fixed arc-breaking contacts provided on said terminal bar.

2. The circuit breaker according to claim 1, wherein the translatable adjustment supports are made as slides running in slots, defined in abutments of the box of the circuit breaker, and wherein said supports have means for adjusting the position of the slides.

3. The circuit breaker according to claim 2, wherein each slide exhibits laterally a seat for a head of a screw, said screw being inserted into a threaded hole defined on a projection made laterally to the slot and wherein the screw is locked by a nut.

4. The circuit breaker according to claim 3, wherein the seat defined on the slide has its inner surfaces in contact with upper and lower faces of the head of the screw.

5. The circuit breaker according to claim 2, wherein the slides have housings for pins arranged at the ends of the operating shaft, said housings being made of self-lubricating material.

* * * * *